US005479737A

United States Patent [19]

Osborne et al.

[11] Patent Number: 5,479,737

[45] Date of Patent: Jan. 2, 1996

[54] FIREARM BARREL ASSEMBLY

[75] Inventors: William E. Osborne; Timothy V. Blazek, both of Guilford, Conn.

[73] Assignee: The Marlin Firearms Company, North Haven, Conn.

[21] Appl. No.: 190,889

[22] Filed: Feb. 3, 1994

[51] Int. Cl.[6] ..... F41A 21/12

[52] U.S. Cl. ..... 42/76.01; 89/14.05

[58] Field of Search ..... 89/14.05, 15, 16, 89/29; 42/76.01, 76.02

[56] References Cited

U.S. PATENT DOCUMENTS

| | | | |
|---|---|---|---|
| 1,309,163 | 7/1919 | Walpole | 89/16 |
| 2,935,912 | 5/1960 | Hartley | 42/76.02 |
| 3,235,996 | 2/1966 | Maillard | 42/76.01 |
| 3,943,821 | 3/1976 | Seifried | 89/16 |

FOREIGN PATENT DOCUMENTS

| | | | |
|---|---|---|---|
| 1329202 | 4/1963 | France | 42/76.01 |
| 548102 | 4/1932 | Germany | 42/76.01 |
| 2045738 | 3/1972 | Germany | 42/76.01 |
| 270630 | 1/1930 | Italy | 42/76.01 |
| 423747 | 5/1948 | Italy | 42/76.01 |
| 144607 | 3/1931 | Switzerland | 42/76.01 |

OTHER PUBLICATIONS

English Translation of German Patent No. 2045738 (Mauser–Werke AG).

English Translation of Swiss Patent No. 144607 (Surber).

*Primary Examiner*—Stephen M. Johnson
*Attorney, Agent, or Firm*—Chilton, Alix & Van Kirk

[57] ABSTRACT

An improved firearms barrel assembly having a cartridge chamber insert disposed in the butt end of a barrel and a pin for locking the insert in the barrel. The insert has a plurality of longitudinally extending grooves for equalizing pressure across a cartridge case. The multi-component construction of the assembly facilities production of the grooves.

15 Claims, 5 Drawing Sheets

FIREARM BARREL ASSEMBLY

BACKGROUND OF THE INVENTION

This invention relates generally to firearms barrels. More particularly, this invention relates to firearms barrel cartridge chambers embodying release grooves.

The pressure developed within the cartridge case on firing a bullet tends to deform the case and press it tightly against the inner wall of the cartridge chamber. Consequently, friction between the cartridge case and cartridge chamber may become so great that extraction of the case becomes extremely difficult.

It has long been recognized in the art that equalizing the pressure across the case will reduce case deformation and improve case extraction. Typically, longitudinal grooves are formed in the cartridge chamber wall to equalize the pressure. It is desired that the grooves have an accurate width and depth, that they commence at an exactly defined point at the forward end of the cartridge chamber and follow the tapered rearward enlargement of the cartridge chamber. Such conventional grooved structures have proved effective in facilitating case extraction but are extremely difficult to produce.

A number of cartridge chamber designs and methods for forming cartridge chambers have been advanced. For example, Koch U.S. Pat. No. 3,736,693 discloses a cartridge chamber having a polygonal cross-section that merges into a circular profile near the outer end of the cartridge chamber. The corners of the polygonal cross-section are rounded to form the release grooves.

Seifried U.S. Pat. No. 3,943,821 discloses a tubular member threadably mounted within a barrel. The tubular member has balance grooves which exceed the number of grooves in the bullet chamber of the barrel. Due to the increased number of gas pressure balance grooves within the powder portion of the cartridge chamber, the surface area which supports the cartridge is reduced. The slide resistance of the cartridge is thereby substantially decreased. The grooves extend from a cylindrical annular groove formed between the tubular member and the inner end of the barrel to a point forward of the tubular member rear face.

Lee U.S. Pat. No. 2,464,323 discloses a punch which is employed for fluting gun barrel chambers.

SUMMARY OF THE INVENTION

Briefly stated, the invention in a preferred form is a barrel assembly having a cartridge chamber insert, a barrel and a pin. The cartridge chamber insert has an axial bore with a plurality of longitudinally extending angularly spaced grooves. The insert has a partial transverse groove that is substantially tangential to a point on the insert outer surface. The barrel has a breech end, a muzzle end and a stepped coaxial throughbore wherein the cartridge chamber insert is received in the breech end bore. The breech end has a transverse bore that is coaxial to the insert outer groove. The pin is inserted into the breech end transverse bore and insert outer groove.

The cartridge chamber is manufactured separately from the barrel, facilitating all forming, machining and inspection operations. The pressure equalizing grooves may be formed by any number of metal forming or machining operations. The pressure equalizing grooves may extend part of the length of the chamber insert. Alternately, the pressure equalizing grooves may extend the full length of the chamber insert, further facilitating the manufacturing operations.

An object of the present invention is to provide a new and improved barrel assembly for firearms.

Another object of the invention is to provide a separate cartridge chamber insert to facilitate barrel manufacturing operations thereby providing a barrel assembly which may be produced in an efficient and low cost manner.

A further object of the invention is to provide a cartridge chamber insert having pressure equalizing grooves which may be manufactured in a highly efficient operation.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DETAILED DESCRIPTION OF THE PREFERRED EMBODIMENT

With reference to the drawings wherein like numerals represent like parts throughout the figures, an improved firearm barrel assembly in accordance with the present invention is generally designated with the numeral 10. The assembly includes a cartridge chamber insert 40, a barrel 20 and a pin 30.

Figure 8:
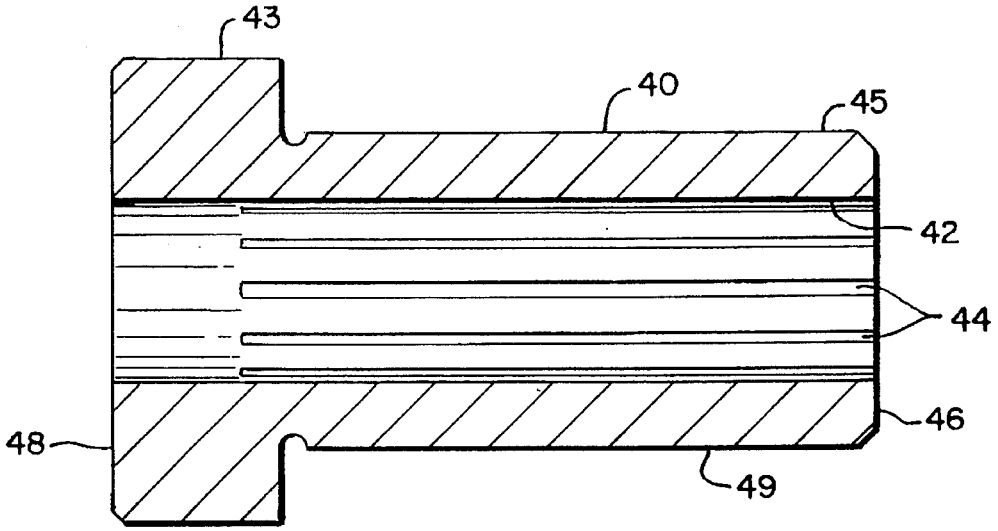
FIG. 8 is an alternative embodiment of the insert portion of FIG. 6.
Figure 9:
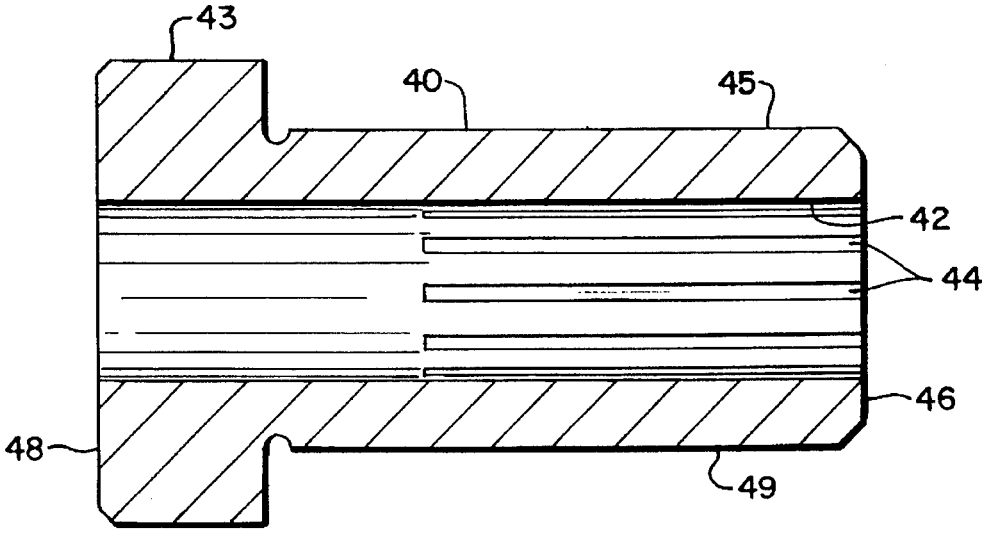
FIG. 9 is another alternative embodiment of the insert portion of FIG. 6.

The cartridge chamber insert 40 has an axial bore 42 having a plurality of longitudinally extending, angularly spaced grooves 44. The grooves 44 are parallel and generally identically dimensioned. In a preferred embodiment, the grooves 44 extend the full length of the bore 42. In alternate embodiments shown in FIGS. 8 and 9, the grooves 44 extend part of the length of the bore 42. The insert has front 46 and rear 48 ends and an outer surface 49. The bore 42 may taper from the insert rear end 48 to the insert front end 46.

The barrel 20 has a barrel portion 23 and a breech portion 24 defining stepped first 21 and second 22 axial bores. The second bore 22 coaxially receives the insert 40. In one embodiment, a tapered intermediate bore 28 is located between the first 21 and the second bore 22. In a preferred embodiment, a threaded surface 25 traverses the outer surface of the breech portion 24.

Figure 1:
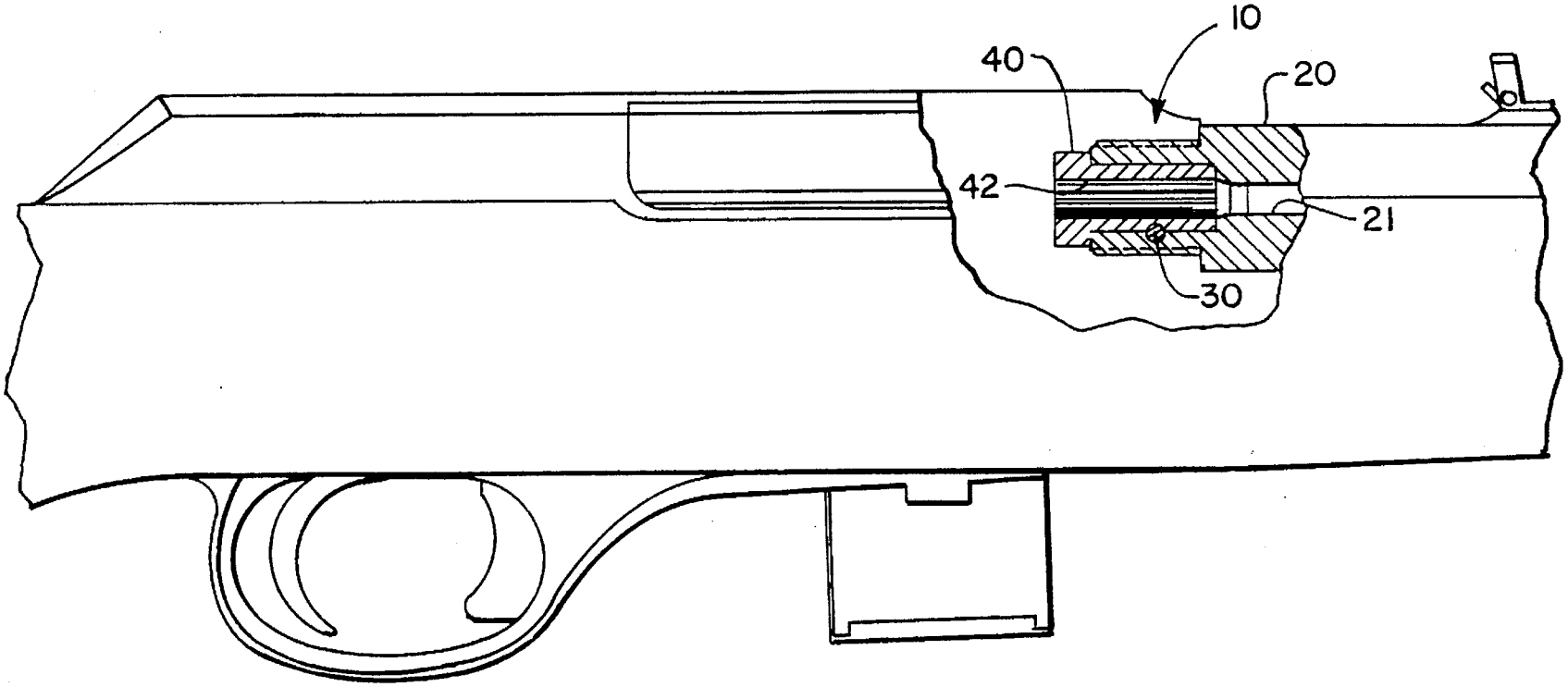
FIG. 1 is a fragmentary longitudinal view, partly in section, of a firearm having a barrel assembly in accordance with the present invention.
Figure 2:
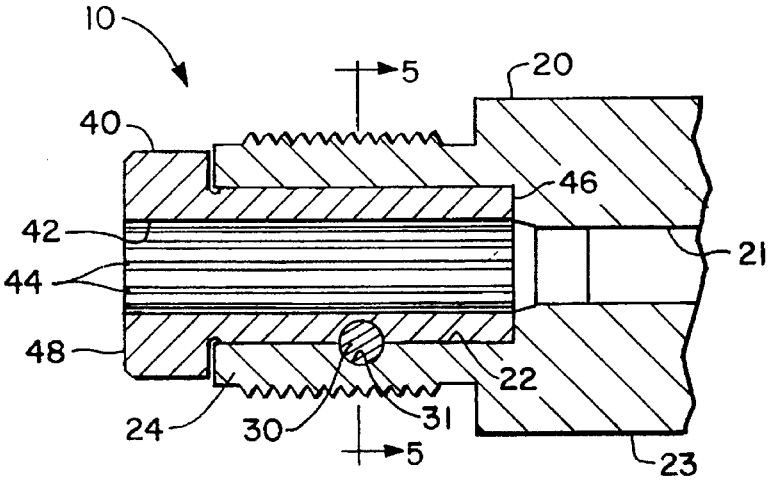
FIG. 2 is a longitudinal sectional view through the rear part of a barrel assembly of FIG. 1.
Figure 3:
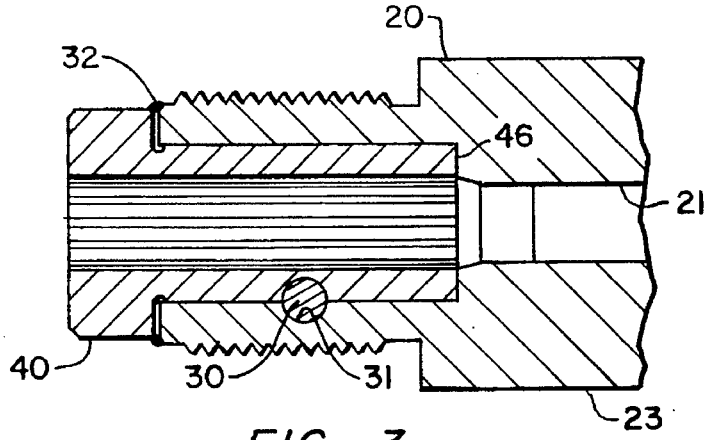
FIGS. 3 and 4 are longitudinal sectional views through alternate embodiments of a barrel assembly in accordance with the present invention.
Figure 4:
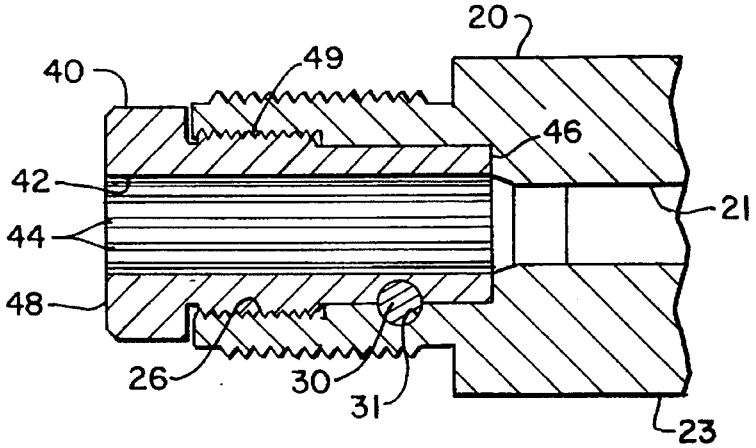
Figure 5:
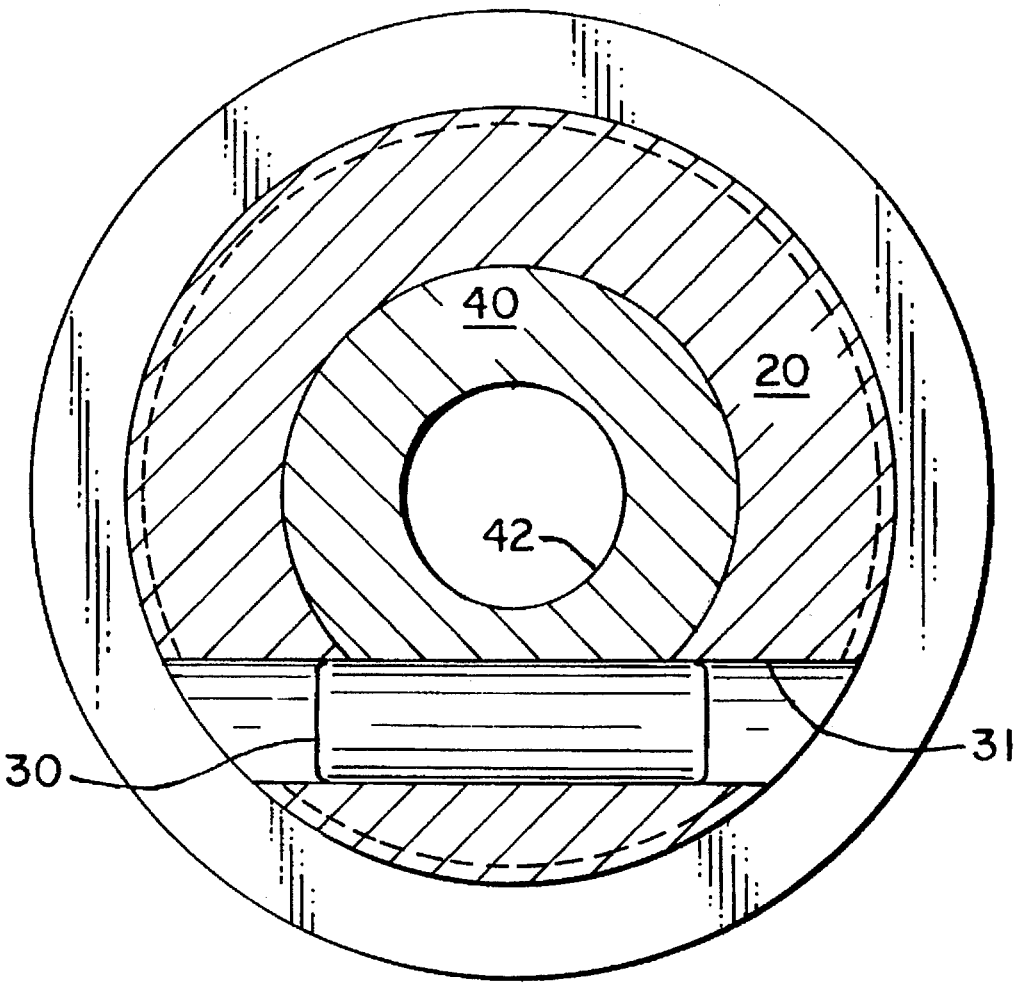
FIG. 5 is a cross-sectional view of the barrel assembly of FIG. 2 taken along the line 5—5 thereof.
Figure 6:
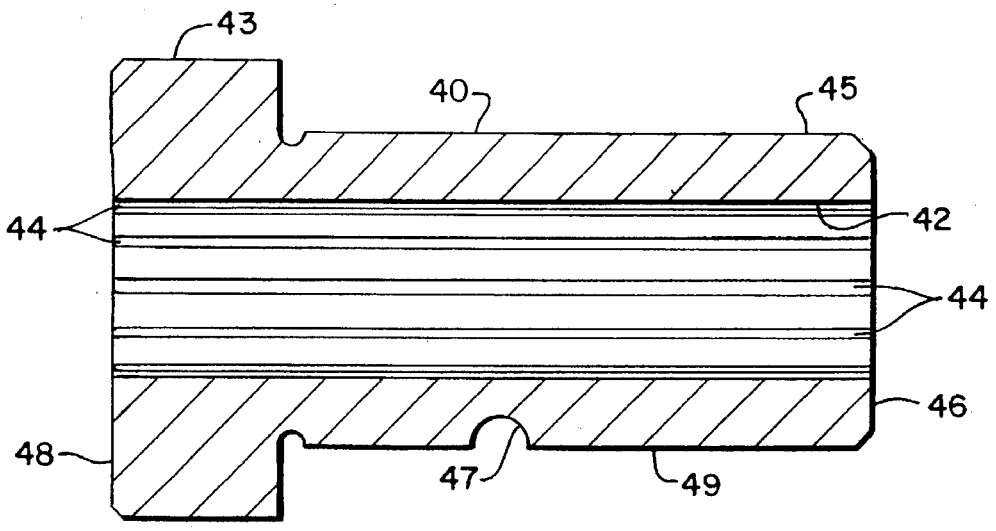
FIG. 6 is an enlarged longitudinal sectional view through an insert portion of the barrel assembly of FIG. 1.
Figure 7:
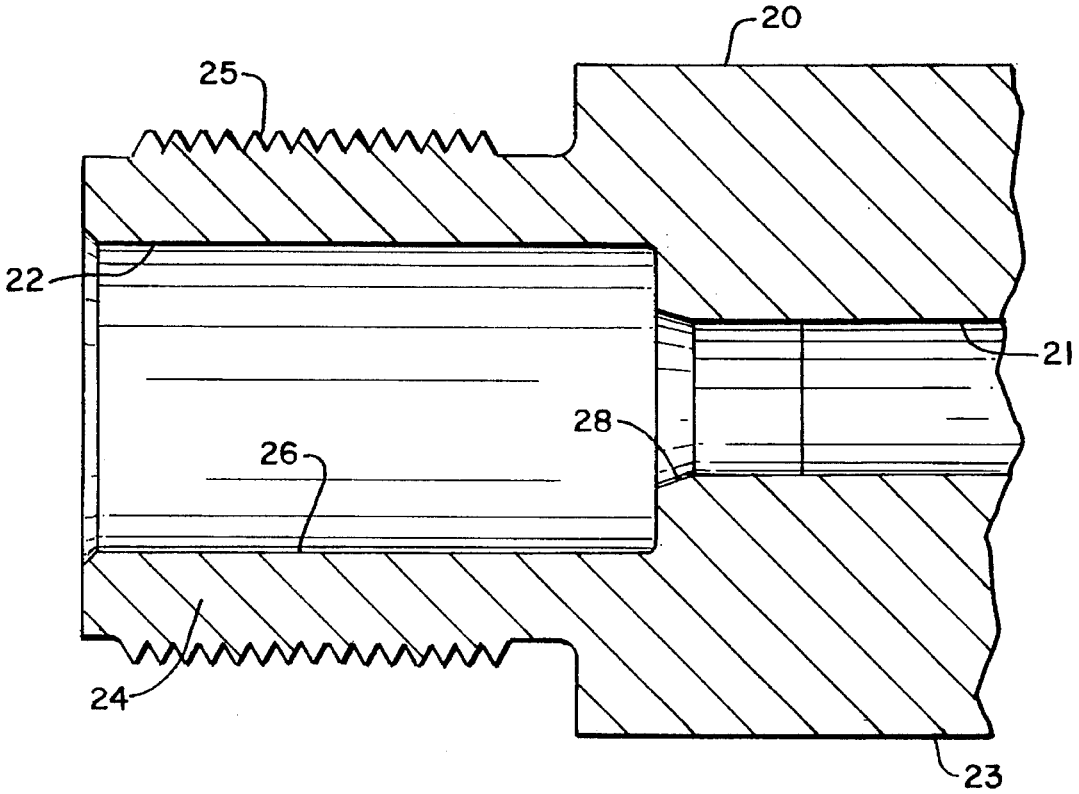
FIG. 7 is an enlarged longitudinal sectional view through a barrel portion of the barrel assembly of FIG. 1.

The insert 40 is slidably received in the second bore 22. An adhesive, such as LOCTITE™ may be applied to the insert outer surface 49 before it is inserted in the second bore 22. A transverse bore 31 having an axis substantially tangential to the insert outer surface 49 and the second bore surface 26 is drilled through the breech portion 24 and the insert 40. Alternatively, the insert 40 has a groove 47 that has an axis substantially tangential to the insert outer surface 49 and the breech portion has a complementary transverse bore 31 that is aligned with the insert groove 47. A pin 30 is inserted in the transverse bore 31 to lock the barrel 20 and the insert 40 together. In addition to the pin 30, alternative embodiments utilize additional means to lock the barrel 20 to the insert 40. In FIG. 3, a weldment 32 between the barrel 20 and the insert 40 is utilized. Alternatively, a portion of the insert outer surface 49 and a portion of the breech portion inner surface 26 may be threaded wherein the barrel 20 and insert 40 are further locked together by a threading engagement, as shown in FIG. 4.

The cartridge chamber insert is manufactured separately from the barrel. Both ends and all surfaces of the insert are easily accessible for forming, machining and inspection operations. This flexibility allows the optimum manufacturing operation to be developed for each firearm model and cartridge case diameter and length, reducing production time and costs.

In a preferred embodiment, the insert rear portion 43 has a diameter of 0.64 inches. The front portion 45 has a diameter of 0.437 inches. The bore 42 has a diameter of 0.246 inches at the rear end and 0.243 inches at the front end. Sixteen longitudinally extending grooves 44 having a width of 0.016 inches and positioned at a uniform maximum distance from the central bore axis of approximately 0.125 inches are angularly spaced on the bore 44 surface. The barrel breech portion 24 has a bore 22 diameter of 0.4375 inches. The barrel bore 28 adjacent to the breech portion 24 tapers from a diameter of 0.254 inches to 0.219 inches within a distance of 0.25 inches from the breech end 24. A 0.125 inch diameter pin 30, locks the insert 40 and barrel 20 together.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A barrel assembly for a firearm comprising:

a cartridge chamber insert defining an axial bore, said insert bore having a plurality of first longitudinally extending angularly spaced grooves, said insert further having front and rear ends and an outer surface, said first grooves extending longitudinally from said rear end to said front end and said outer surface having a second transverse groove;

a barrel defining a first axial bore and a breech portion, said breech portion defining a second bore coaxial to said first axial bore, said second bore axially receiving said insert, said breech portion having a transverse bore, said transverse bore being aligned with said insert second groove; and pin means disposed within said insert second groove and said transverse bore.

2. The barrel assembly of claim 1 wherein said insert bore is tapered from said rear end to said front end.

3. The barrel assembly of claim 2 wherein said first grooves extend an equal axial distance along their longitudinal length.

4. The barrel assembly of claim 1 wherein said insert is further connected to said breech portion by a weldment.

5. The barrel assembly of claim 1 wherein said insert outer surface is threadably connected to said barrel.

6. A barrel assembly for a firearm comprising:

a cartridge chamber insert defining an axial bore, said insert bore having a plurality of longitudinally extending angularly spaced grooves, said insert further having an outer surface and opposite first and second ends, said grooves extending longitudinally from said first end to said second end;

a barrel defining a first axial bore, and a breech portion, said breech portion defining a second bore coaxial to said first bore, said second bore axially receiving said insert;

bore means for forming a bore defined by portions of said insert and barrel; and pin means disposed within said bore means for locking said insert with said barrel.

7. The barrel assembly of claim 6 wherein said insert axial bore is tapered from said first end to said second end.

8. The barrel assembly of claim 7 wherein said first grooves extend an equal axial distance along their longitudinal length.

9. The barrel assembly of claim 6 wherein said insert is further connected to said breech portion by a weldment.

10. The barrel assembly of claim 6 wherein said insert outer surface is threadably connected to said barrel.

11. A firearm having a barrel assembly, a stock receiver means and trigger means, said barrel assembly comprising:

a cartridge chamber insert defining an axial bore, said insert bore having a plurality of longitudinally extending angularly spaced grooves, said insert further having an outer surface and opposite first and second ends, said grooves extending longitudinally from said first end to said second end;

a barrel having a first axial bore and a breech portion, said breech portion defining a second bore coaxial to said first bore, said second bore axially receiving said insert;

bore means for forming a bore defined by portions of said insert and barrel; and pin means disposed within said bore means for locking said insert with said barrel.

12. The firearm of claim 11 wherein said insert axial bore is tapered from said first end to said second end.

13. The firearm of claim 12 wherein said grooves extend an equal axial distance along their longitudinal length.

14. The firearm of claim 11 wherein said insert is further connected to said breech portion by a weldment.

15. The firearm of claim 11 wherein said insert outer surface is threadably connected to said barrel.

* * * * *